US007926569B1

(12) United States Patent
Wintill et al.

(10) Patent No.: US 7,926,569 B1
(45) Date of Patent: Apr. 19, 2011

(54) BYPASS DEVICE FOR WELLBORES

(75) Inventors: Charles David Wintill, Houston, TX (US); William John Darnell, Houston, TX (US); William Ryle Darnell, St. Martinville, LA (US); Rodney Wayne Long, Cypress, TX (US); Todd Ulrich Chretien, Lafayette, LA (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 12/821,601

(22) Filed: Jun. 23, 2010

(51) Int. Cl.
*E21B 34/10* (2006.01)

(52) U.S. Cl. ..... 166/319; 166/373

(58) Field of Classification Search ..... 166/319, 166/321, 373
See application file for complete search history.

(56) References Cited

U.S. PATENT DOCUMENTS

| | | | | |
|---|---|---|---|---|
| 4,880,060 | A * | 11/1989 | Schwendemann et al. | 166/336 |
| 6,536,530 | B2 * | 3/2003 | Schultz et al. | 166/375 |
| 7,243,740 | B2 | 7/2007 | Frith | |
| 7,665,527 | B2 * | 2/2010 | Loretz | 166/373 |
| 7,878,252 | B2 * | 2/2011 | Smith et al. | 166/375 |
| 2003/0168219 | A1 * | 9/2003 | Sloan | 166/373 |
| 2007/0012459 | A1 * | 1/2007 | Buyers et al. | 166/386 |
| 2009/0050333 | A1 * | 2/2009 | Smith et al. | 166/375 |
| 2009/0255878 | A1 | 10/2009 | Himmel | |
| 2010/0038093 | A1 * | 2/2010 | Patel | 166/375 |

* cited by examiner

*Primary Examiner* — Hoang Dang
(74) *Attorney, Agent, or Firm* — Buskop Law Group, PC; Wendy Buskop

(57) ABSTRACT

A bypass device for bypassing a hydraulic piston in a wellbore with an outer tubular body. The outer tubular body can have a fluid control manifold. The fluid control manifold can have two control paths, two high pressure fluid paths, and two valves connecting with two high pressure fluid connecting paths. An inner tubular body can be disposed within the outer tubular body, and a piston chamber can be disposed between the inner tubular body and the outer tubular body. The piston chamber can include two piston chamber sections separated by a hydraulic piston.

14 Claims, 4 Drawing Sheets

BYPASS DEVICE FOR WELLBORES

FIELD

The present embodiments generally relate to a bypass device for use in a wellbore.

BACKGROUND

A need exists for a simple bypass tool to simply and easily direct and redirect fluid flow in a wellbore during production.

A further need exists for a downhole bypass tool that can be used in emergency situations. For example, a hydraulic downhole sleeve can fail to shift hydraulically, and a downhole bypass tool can prevent hydraulic lock, while the hydraulic downhole sleeve can be shifted mechanically. This can allow hydrocarbon production to be controlled without intervention.

The present embodiments meet these needs.

DETAILED DESCRIPTION OF THE EMBODIMENTS

Figure 1:
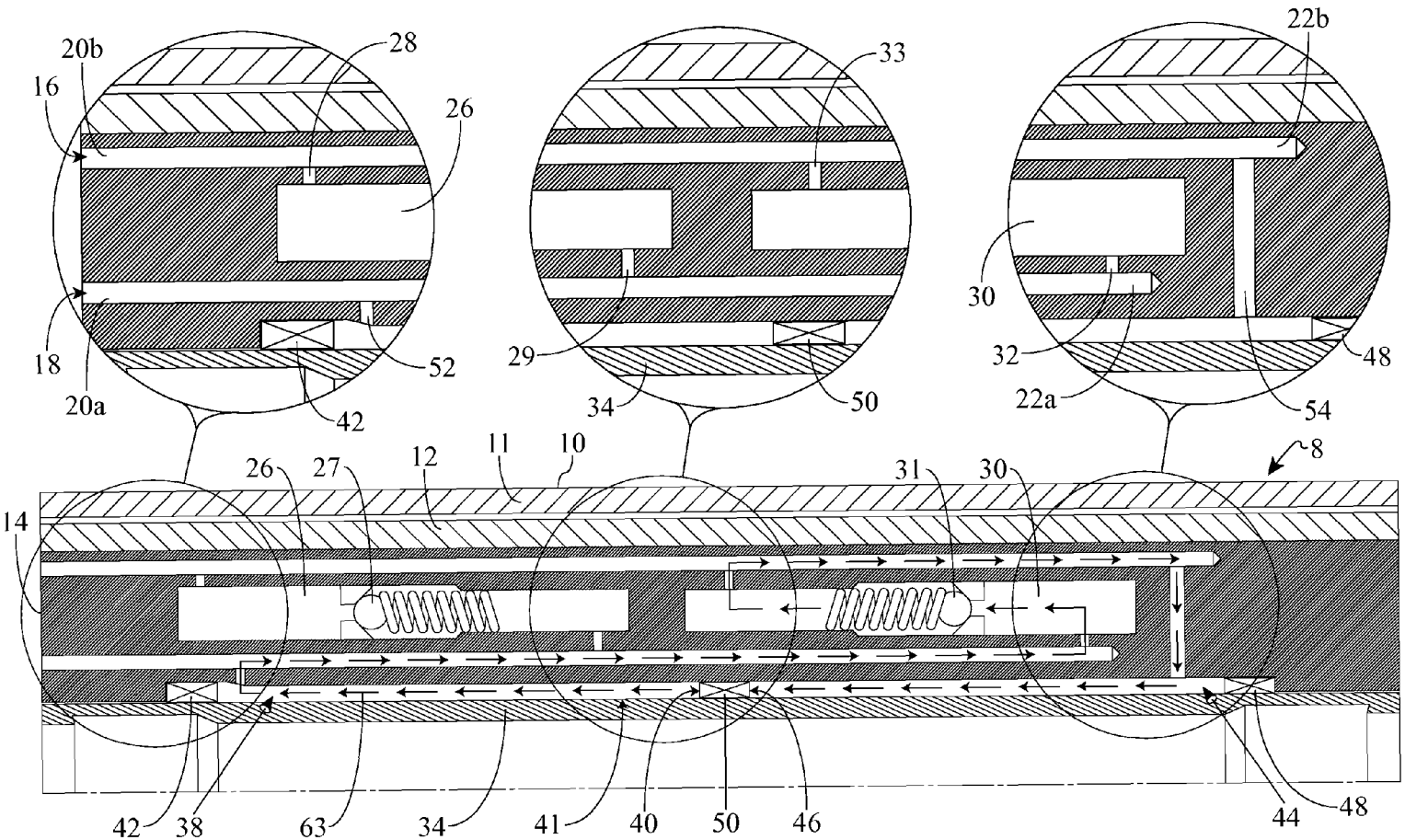
FIG. 1 is a view of a bypass device inside a wellbore.

Before explaining the present apparatus in detail, it is to be understood that the apparatus is not limited to the particular embodiments and that it can be practiced or carried out in various ways.

The present embodiments generally relate to a bypass device for a wellbore.

In one or more embodiments, seals of the bypass device can hold pressure until the bypass device is engaged. This can allow the seals to be tested at the surface before the bypass device is deployed into the wellbore.

The bypass device can be easy to assemble. The bypass device can be disposed within a tubular without increasing the outer diameter of the tubular. Accordingly, the bypass device can be disposed within a tubular of a tubing string, and the outer diameter of the tubing string can remain constant.

The bypass device can be reusable. For example, the bypass device can be used for a first wellbore and then removed and reinstalled into another wellbore for use.

The bypass device can be used to bypass a hydraulic piston in a wellbore.

The bypass device can have an outer tubular body. The outer tubular body can have an inner diameter ranging from about 1 inch to about 12 inches, and a length ranging from about 3 inches to about 15 inches. The outer tubular body can have a wall thickness ranging from about 0.1 inches to about 14 inches.

The outer tubular body can be threaded on each end. The outer tubular body can have a fluid control manifold. Both the outer tubular body and the fluid control manifold can be made of a material such as stainless steel, carbon steel, chrome based steel alloy, nickel steel alloy, a composite material, or another material capable of withstanding downhole environments.

A first fluid control path and a second fluid control path can be formed within the fluid control manifold. For example, the fluid control paths can be bored into the fluid control manifold. Each fluid control path can have a top end and a bottom end.

Each fluid control path can have an inner diameter ranging from about 0.1 inches to about 0.5 inches, and a length ranging from about 1 inch to about 10 inches. The flow rate of fluid in the fluid control paths can range from about 0.1 gallons per minute to about 10 gallons per minute.

The fluid control manifold can have a first high pressure fluid path. Pressure within the first high pressure fluid path can range from about 100 psi to about 5,000 psi.

The first high pressure fluid path can have a first valve, which can be a pressure relief check valve, such as a PHRA2815520D model number made by Lee Company from Westbrook, Conn.

The first high pressure fluid path can be in fluid communication with a first high pressure fluid connecting path and one of the top ends. Pressure within the first high pressure fluid connecting path can range from about 1,500 psi to about 5,900 psi. The first high pressure fluid connecting path can have a diameter from about 0.1 inches to about 0.3 inches. For example, the first high pressure fluid connecting path can have a diameter that is 0.281 inches.

The bypass device can have a second high pressure fluid path with a second valve. The second high pressure fluid path can be in fluid communication with a second high pressure fluid connecting path and with one of the bottom ends. Pressure within the second high pressure fluid connecting path can be from about 1,500 psi to about 5,900 psi.

The first valve and the second valve can provide for a safer operation because they can allow pressure to be maintained on a control line.

The second high pressure fluid connecting path can have a diameter that is the same as the diameter of the first high pressure fluid connecting path, or is a slight variation of the diameter of the first high pressure fluid connecting path. For example, one high pressure fluid connecting path can have a diameter from about 0.2 inches to about 0.4 inches, while the other high pressure fluid connecting path can have a diameter that is 0.281 inches.

The bypass device can include an inner tubular body that can be disposed within the outer tubular body. The inner tubular body can have an inner diameter from about 2.0 inches to about 7.0 inches, and a length from about 10.0 inches to about 25.0 inches.

The inner tubular body can have a piston chamber. The piston chamber can have an overall length from about 10.0 inches to about 25.0 inches. The piston chamber can have a general volume ranging from about 5 fluid oz to about 64 fluid oz. The piston chamber can be disposed between the inner tubular body and the outer tubular body.

A hydraulic piston can be disposed within the piston chamber. The hydraulic piston can have a first end and a second end. The hydraulic piston can be or include elastomeric material or Peek. For example, the hydraulic piston can be made of Peek Seal Stacks. The hydraulic piston can have a diameter from about 3.0 inches to about 7.0 inches. The hydraulic piston can be one made by Accuseal of Houston, Tex. The hydraulic piston can move within the piston chamber.

In one or more embodiments, the hydraulic piston can divide the piston chamber into a first piston chamber section and a second piston chamber section. For example, the first piston chamber section can be between the first piston end and a first seal, and the second piston chamber section can be between the second piston end and a second seal.

The first seal and the second seal can each be a thermoplastic seal, such a Peek Seal Stacks manufactured by Accuseal of Houston, Tex. The first seal and the second seal can each be a rubber seal or an elastomeric seal.

A first fluid port can be in fluid communication with the top end of the first fluid control path. The first fluid port can also be in fluid communication with the first chamber section. The first fluid port can have a diameter from about 0.156 inches to about 0.50 inches, which can enable a fluid flow with a flow rate from about 5 fluid oz per minute to about 64 fluid oz per minute. Fluid can flow within the first fluid port at a pressure from about 500 psi to about 5,000 psi.

The bypass device can include a second fluid port, which can be in fluid communication with the first fluid control path bottom end, and in fluid communication with the second piston chamber section. The second fluid port can have a diameter from about 0.125 inches to about 0.500 inches, which can enable a fluid flow with a rate from about 5 fluid oz per minute to about 64 fluid oz per minute at a pressure from about 500 psi to about 5,000 psi.

A first fluid bypass can be formed by externally moving the inner tubular body a distance of from about 10 inches to about 25 inches, and moving the hydraulic piston in a first fluid flow direction, thereby forcing the first fluid into the second fluid control path at the top end and then to the second fluid control path bottom end.

The first fluid can then be moved from the second fluid control path bottom end to the second high pressure fluid connecting path, then to the second high pressure fluid path, across the second valve, to a second low pressure fluid path, to the first fluid control path bottom end, out of the second fluid port, and can then enter the second piston chamber section.

The first fluid can be water, a water based control fluid, a hydraulic oil, or an oil based control fluid.

A second fluid bypass can be formed by externally moving the inner tubular body and the hydraulic piston in a second fluid flow direction, thereby forcing the first fluid out of the second piston chamber section, through the second fluid port, into the first fluid control path bottom end, to the first fluid control path top end, into the first high pressure fluid connecting path, to the first high pressure fluid path, through the first valve, into a first low pressure fluid path, to the second fluid control path top end, into the first fluid port, and then into the first piston chamber section.

Embodiments can include one or more slots which can be formed in the outer tubular body. The slots can be used to contain control lines, communication lines, or combinations thereof.

The bypass device can use valves. The pressure ratings of the valves can be similar to one another or different from one and another.

The outer tubular body can have inner threads for engagement with the inner tubular body. The outer tubular body can have outer threads for engaging a downhole valve body, such as a sliding sleeve.

The flow rate in the bypass device can range from about 1 fluid oz per minute to about 2 gallons per minute.

The bypass device can permit a fluid to flow in either direction up to a pressure of about 20,000 psi, without deformation of the bypass device.

Each valve can withstand a pressure from about 2,000 psi to about 18,000 psi without deformation of the valve.

The outer tubular body can be made from a different material or metal than the inner tubular body, thereby allowing the outer tubular body to have a different physical property than the inner tubular body.

The fluid control manifold can have from about 2 to about 8 fluid control paths. Each fluid control path can have a top end and a bottom end.

The valves can be pressure check valves, such as model PHRA2815520D made by Lee Company, Pressure Relief Check Valves, or another valve.

In one or more embodiments, the bypass device can be used for fluid that can have up to 10 percent particulate, with a diameter of the particulate being 10 microns or less.

Turning now to the Figures, FIG. 1 is schematic view of the bypass device 8 inside a wellbore 10. The wellbore 10 can be a deviated, horizontal, or vertical wellbore. The wellbore 10 can have a casing 11, or the wellbore 10 can be an open wellbore.

The bypass device 8 can have an outer tubular body 12 disposed about an inner tubular body 34.

A fluid control manifold 14 can have a first fluid control path 16 in parallel with a second fluid control path 18. The first fluid control path 16 can have a top end 20*b* and a bottom end 22*b*, and the second fluid control path 18 can have a top end 20*a* and a bottom end 22*a*.

A first high pressure fluid path 26 can have a first pressure relief valve 27. The first pressure relief valve 27 can be in fluid communication with a first high pressure fluid connecting path 28 and with the top end 20*b*.

A second high pressure fluid path 30 can have a second pressure relief valve 31. The second pressure relief valve 31 can be in fluid communication with a second high pressure fluid connecting path 32 and with the bottom end 22*a*.

A first fluid port 52 can be in fluid communication with the top end 20*a*. A second fluid port 54 can be in fluid communication with the bottom end 22*b*.

The bypass device 8 can include a first low pressure fluid path 29 and a second low pressure fluid path 33.

A piston chamber 41 can include a first chamber section 38 and a second chamber section 44. The piston chamber 41 can be disposed between the inner tubular body 34 and the outer tubular body 12.

The first fluid port 52 can be in fluid communication with the first chamber section 38.

The second fluid port 54 can be in fluid communication with the second chamber section 44.

The first chamber section 38 can be formed between a first piston end 40 and a first seal 42.

The second chamber section 44 can be formed between a second piston end 46 and a second seal 48.

In operation, the bypass device 8 can be incorporated into a hydraulic system used to control one or more downhole valves, such as sliding sleeves. If the hydraulic system is operating properly, the downhole valve can be shifted or actuated by selectively providing hydraulic pressure to one of the fluid control path 16 or 18. However, if a failure occurs in the hydraulic system, the bypass device 8 can be actuated to prevent hydraulic lock within the hydraulic system and allow for mechanical shifting of the downhole valves.

To operate or actuate the bypass device 8, the inner tubular body 34 is moved, for example with a shifting tool. As the inner tubular body 34 is moved, the hydraulic piston 50 is also moved. In one or more embodiments, the hydraulic piston 50 and the inner tubular body 34 can be moved towards the top ends 20*a* and 20*b*. Accordingly, the first fluid 63 within the first chamber section 38 is forced out of the first chamber section 38 and into the second fluid control path 18 via the first fluid port 52.

The first fluid 63 can flow to the bottom end 22*a* because the fluid control paths 18 and 16 are closed off at the surface, for example by a crushed control line, and the movement of the hydraulic piston 50 produces a low pressure in the second chamber section 44 and a high pressure in the first chamber section 38.

The first fluid 63 can flow from the bottom end 22*a* to the second high pressure fluid connecting path 32. The first fluid 63 can flow from the second high pressure fluid connecting path 32 to the second high pressure fluid path 30.

The first fluid 63 can flow within the second high pressure fluid path 30, and through the second high pressure relief valve 31 to the second low pressure fluid path 33.

The first fluid 63 can flow from the second low pressure fluid path 33 to the bottom end 22*b*. From the bottom end 22*b*, the first fluid 63 can flow through the second fluid port 54 and into the second chamber section 44. Accordingly, hydraulic pressure within the hydraulic system is balanced, and hydraulic lock is prevented as the down hole valves are mechanically shifted.

Figure 2:
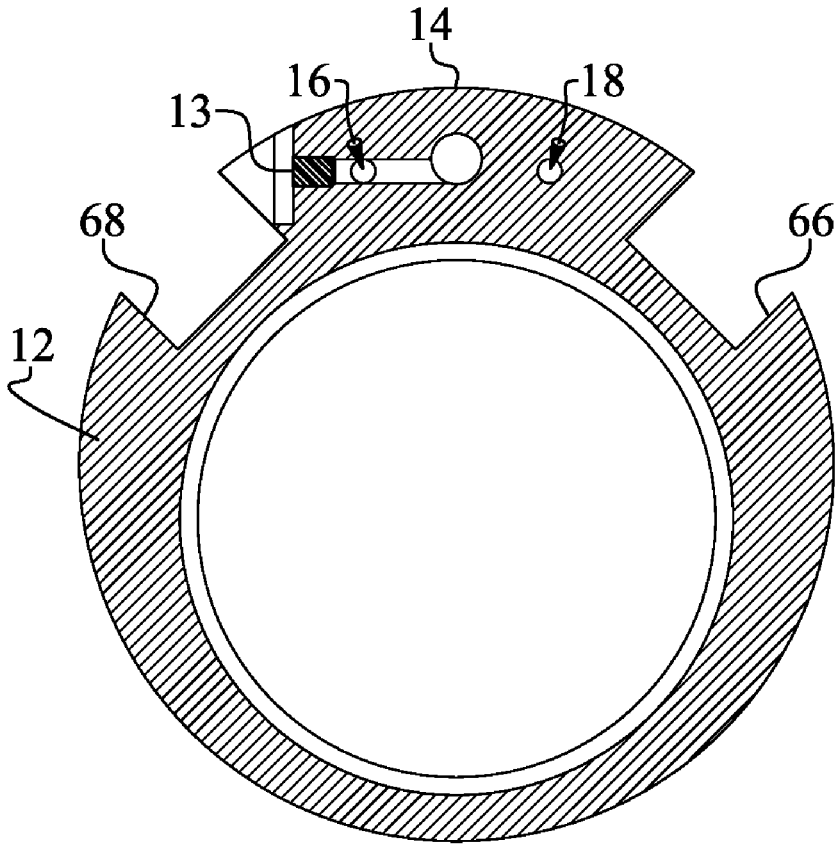
FIG. 2 is a cross sectional view of slots in an outer tubular body.

FIG. 2 is a cross sectional view of slots 66 and 68 in the outer tubular body 12. The slot 66 and the slot 68 can be formed in the fluid control manifold 14. The first fluid control path 16 and the second fluid control path 18 are also depicted. A plug 13 can be used to block a manufacturing hole.

Figure 3:
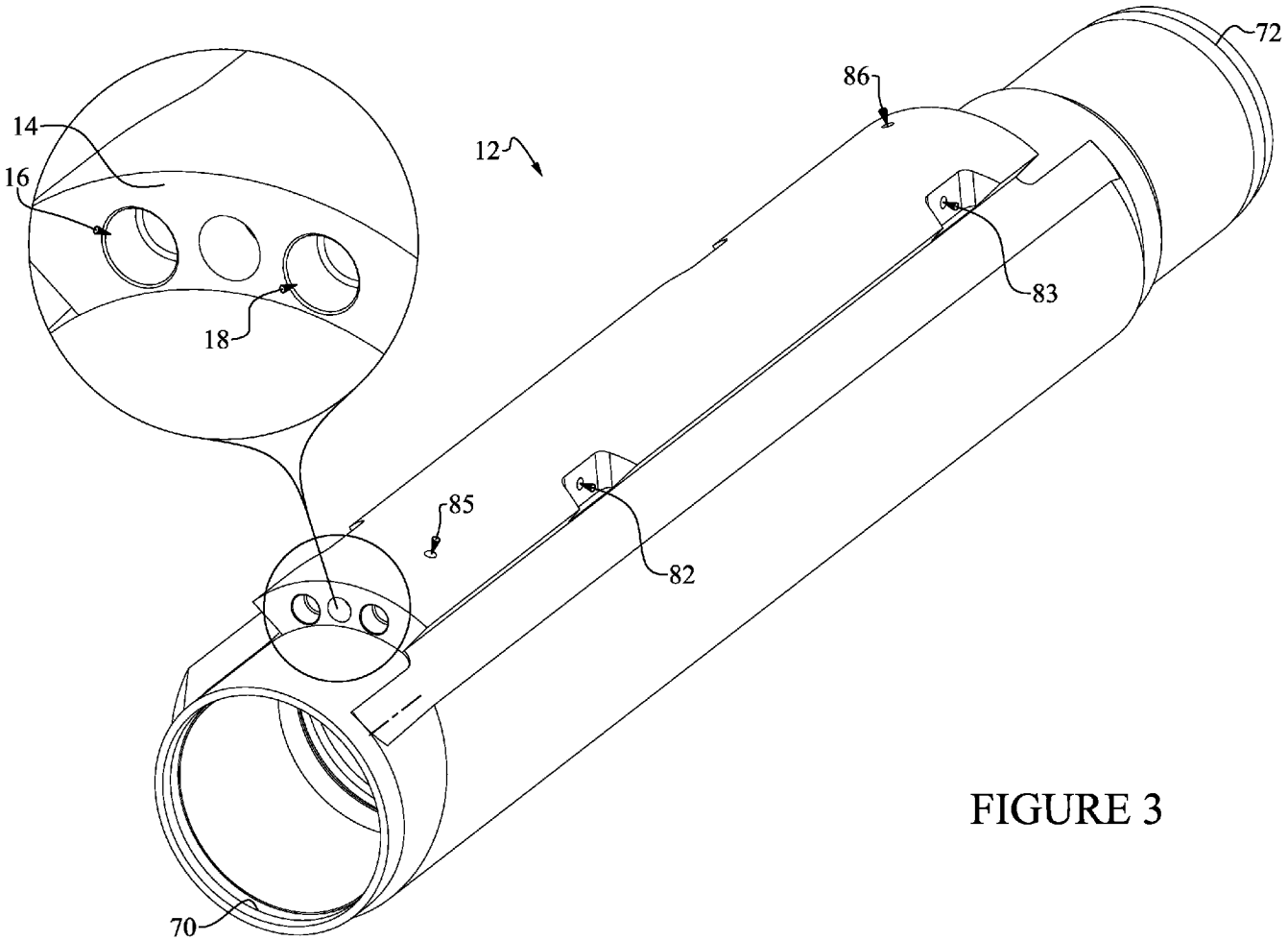
FIG. 3 is an isometric view of the outer tubular body.

FIG. 3 is an isometric view of the outer tubular body 12 having the fluid control manifold 14, inner threads 70, and outer threads 72. The manufacturing holes 82, 83, 85 and 86 can be formed during the formation or manufacturing of one or more flow paths within the bypass device. The manufacturing holes 82, 83, 85, and 86 can be plugged, for example by the plug 13, which is shown in FIG. 2, before the bypass device is integrated into a hydraulic system.

Figure 4:
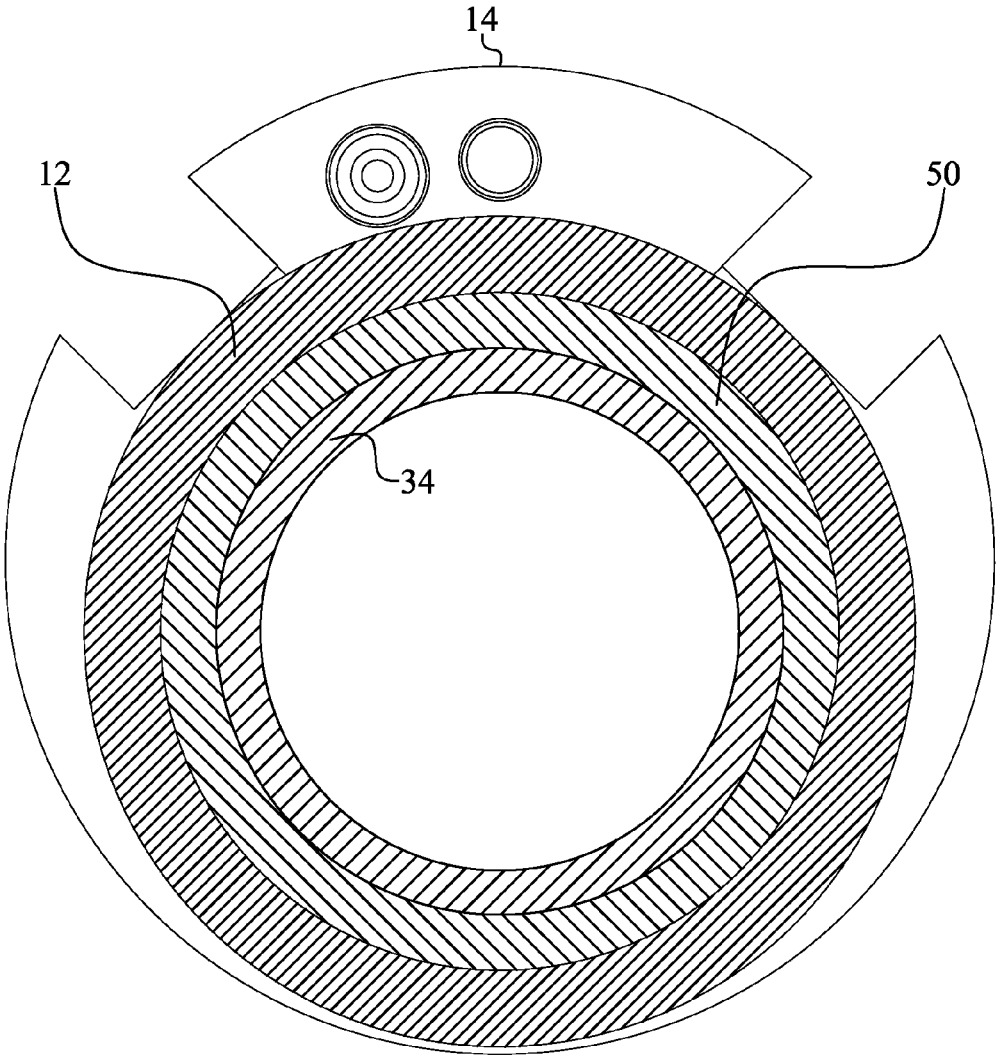
FIG. 4 is a cross sectional view of a piston with an inner tubular body and the outer tubular body.

FIG. 4 is a cross sectional view showing the hydraulic piston 50 with the outer tubular body 12 and the fluid control manifold 14.

The inner tubular body 34 can be within the outer tubular body 12. The hydraulic piston 50 can be disposed between the inner tubular body 34 and the outer tubular body 12.

While these embodiments have been described with emphasis on the embodiments, it should be understood that within the scope of the appended claims, the embodiments might be practiced other than as specifically described herein.

What is claimed is:

1. A bypass device for preventing hydraulic lock in a failed hydraulic system, wherein the bypass device comprises:

a. an outer tubular body, wherein the outer tubular body comprises a fluid control manifold with a first fluid control path and a second fluid control path, wherein the first fluid control path comprises a top end and a bottom end, and wherein the second fluid control path comprises a top end and a bottom end;

b. a first high pressure fluid path, wherein the first high pressure fluid path comprises a first valve, wherein the first high pressure fluid path is in fluid communication with a first high pressure fluid connecting path and the second fluid control path top end;

c. a second high pressure fluid path, wherein the second high pressure fluid path comprises a second valve, wherein the second high pressure fluid path is in fluid communication with a second high pressure fluid connecting path and the first fluid control path bottom end;

d. an inner tubular body disposed within the outer tubular body;

e. a hydraulic piston having a first piston end and a second piston end is disposed within a piston chamber, wherein the piston chamber is disposed between the inner tubular body and the outer tubular body, and wherein the piston chamber comprises:

(i) a first chamber section formed between the first piston end and a first seal; and (ii) a second chamber section formed between the second piston end and a second seal;

f. a first fluid port in fluid communication with the first fluid control path top end and the first chamber section; and g. a second fluid port in fluid communication with the first fluid control path bottom end and the second chamber section.

2. The bypass device of claim 1, wherein the outer tubular body further comprises one or more slots for containing at least one control line, a communication line, or combinations thereof.

3. The bypass device of claim 1, wherein the first valve has a different pressure rating than the second valve.

4. The bypass device of claim 1, wherein the outer tubular body further comprises a plurality of inner threads and outer threads for engaging a downhole valve body simultaneously.

5. The bypass device of claim 1, wherein a flow rate within the bypass device ranges from one fluid ounce per minute to two gallons per minute.

6. The bypass device of claim 1, wherein each valve can withstand a pressure from 2,000 psi to 18,000 psi without deformation.

7. The bypass device of claim 1, wherein the outer tubular body has an inner diameter ranging from 1.25 inches to 12 inches.

8. The bypass device of claim 1, wherein the outer tubular body comprises a stainless steel, a carbon steel, a chrome based steel alloy, a nickel steel alloy, or combinations thereof.

9. The bypass device of claim 1, wherein the outer tubular body comprises a different material than the inner tubular body.

10. The bypass device of claim 1, wherein each valve is a pressure check valve.

11. The bypass device of claim 1, wherein the first seal and the second seal are each thermoplastic seals.

12. The bypass device of claim 1, wherein the hydraulic piston further comprises a thermoplastic sealing device.

13. A bypass device for preventing hydraulic lock in a failed hydraulic system, wherein the bypass device comprises:

a. an inner tubular body disposed within an outer tubular body;

b. a chamber disposed between the inner tubular body and the outer tubular body;

c. a piston disposed within the chamber, wherein the piston separates the chamber into a first section and a second section, wherein the first section is in fluid communication with a first control line, and wherein the second section is in fluid communication with a second control line;

d. a first valve providing fluid communication between the first control line and the second control line, wherein the first valve prevents fluid from flowing from the second control line to the first control line; and e. a second valve providing fluid communication between the second control line and the first control line, wherein the second valve prevents fluid from flowing from the first control line to the second control line.

14. A bypass device for preventing hydraulic lock in a failed hydraulic system, wherein the bypass device comprises:

a. an inner tubular body disposed within an outer tubular body;

b. a chamber disposed between the inner tubular body and the outer tubular body;

c. a piston disposed within the chamber, wherein the piston separates the chamber into a first section and a second section, wherein the first section is in fluid communication with a first control line, and wherein the second section is in fluid communication with a second control line;

d. a first valve providing fluid communication between the first section and the second section, wherein the first valve prevents fluid from flowing from the second section to the first section; and e. a second valve providing fluid communication between the second section and the first section, wherein the second valve prevents fluid from flowing from the first section to the second section.

* * * * *